US005277140A

United States Patent [19]

Nakagaki

[11] Patent Number: 5,277,140

[45] Date of Patent: Jan. 11, 1994

[54] BASE FRAME DRIVING DEVICE OF AN EMBROIDERING MACHINE

[75] Inventor: Hideaki Nakagaki, Kariya, Japan

[73] Assignee: Aisin Seiki Kabushiki Kaisha, Kariya, Japan

[21] Appl. No.: 964,031

[22] Filed: Oct. 21, 1992

[30] Foreign Application Priority Data

Oct. 22, 1991 [JP] Japan ..... 3-274079

[51] Int. Cl.[5] ..... D05B 21/00

[52] U.S. Cl. ..... 112/121.12; 112/103; 112/308; 112/318

[58] Field of Search ..... 112/103, 121.12, 102, 112/63, 121.15, 121.24, 2, 262.2, 262.3, 220, 308, 318

[56] References Cited

U.S. PATENT DOCUMENTS 4,143,605 3/1979 Soeda et al. ..... 112/453
4,457,242 7/1984 Nordstrom ..... 112/121.12
4,998,964 3/1991 Golia ..... 112/103 X
5,040,474 8/1991 Kamijyo ..... 112/121.12
5,167,194 12/1992 Nakagaki ..... 112/103

FOREIGN PATENT DOCUMENTS 62-206077 9/1987 Japan .

*Primary Examiner*—Peter Nerbun
*Attorney, Agent, or Firm*—Burns, Doane, Swecker & Mathis

[57] ABSTRACT

A base frame driving device of an embroidering machine includes a shaft, a holder mounted on the shaft so as to be movable therealong, a connecting portion mounted rotatably on the holder, a base frame mounted on the connecting portion for holding a work piece to be embroidered, a motor mounted to the holder and operatively connected to the base frame for rotation thereof about the shaft and, a controller for controlling the motor in order that the initial position of the base frame relative to the holder is fixed when operation of the embroidering machine is initiated.

4 Claims, 3 Drawing Sheets

BASE FRAME DRIVING DEVICE OF AN EMBROIDERING MACHINE

BACKGROUND OF THE INVENTION

The present invention relates to a base frame driving device of an embroidering machine by which an embroidery is made on a cylindrical work piece.

A conventional base frame driving device of the type disclosed in Japanese Patent Laid-open Print No. Sho62(1987)-206077 published in 1987 without examination comprises a shaft, a holder mounted on the shaft so as to be movable therealong, a connecting portion mounted rotatably on the holder, and a base frame mounted on the connecting portion and holding a work piece to be embroidered. In the conventional device, upon initiation of the embroidering operation, the position of the base frame remains unchanged since the previous embroidering operation has been completed. For this reason, an operator of the embroidering machine has to transfer or bring the base frame to the initial position manually, which involves cumbersome work.

SUMMARY OF THE INVENTION

It is, therefore, a primary object of the present invention to provide a base frame driving device of an embroidering machine in which the base frame is automatically set at an initial position.

It is another object of the present invention to provide a base frame driving device of an embroidering machine in which a simple structure realizes an automatic setting of the base frame at an initial position.

In order to attain the foregoing objects, a base frame driving device of an embroidering machine comprises a shaft, a holder mounted on the shaft so as to be movable therealong, a connecting portion mounted rotatably on the holder, a base frame mounted on the connecting portion and holding a work piece to be embroidered, a motor mounted on the holder and operatively connected to the base frame for rotating the base frame about the shaft and a controller for controlling the motor in order that the initial position of the base frame relative to the holder is fixed when operation of the embroidering machine is initiated.

BRIEF DESCRIPTION OF THE DRAWINGS

The above and other objects, features and advantages of the present invention will be more apparent and more readily appreciated from the following detailed description of preferred exemplarily embodiment of a the present invention, taken in connection with the accompanying drawings, in which.

DESCRIPTION OF THE PREFERRED EMBODIMENT

A preferred embodiment of the present invention will be described below in detail with reference to the accompanying drawings.

Figure 1:
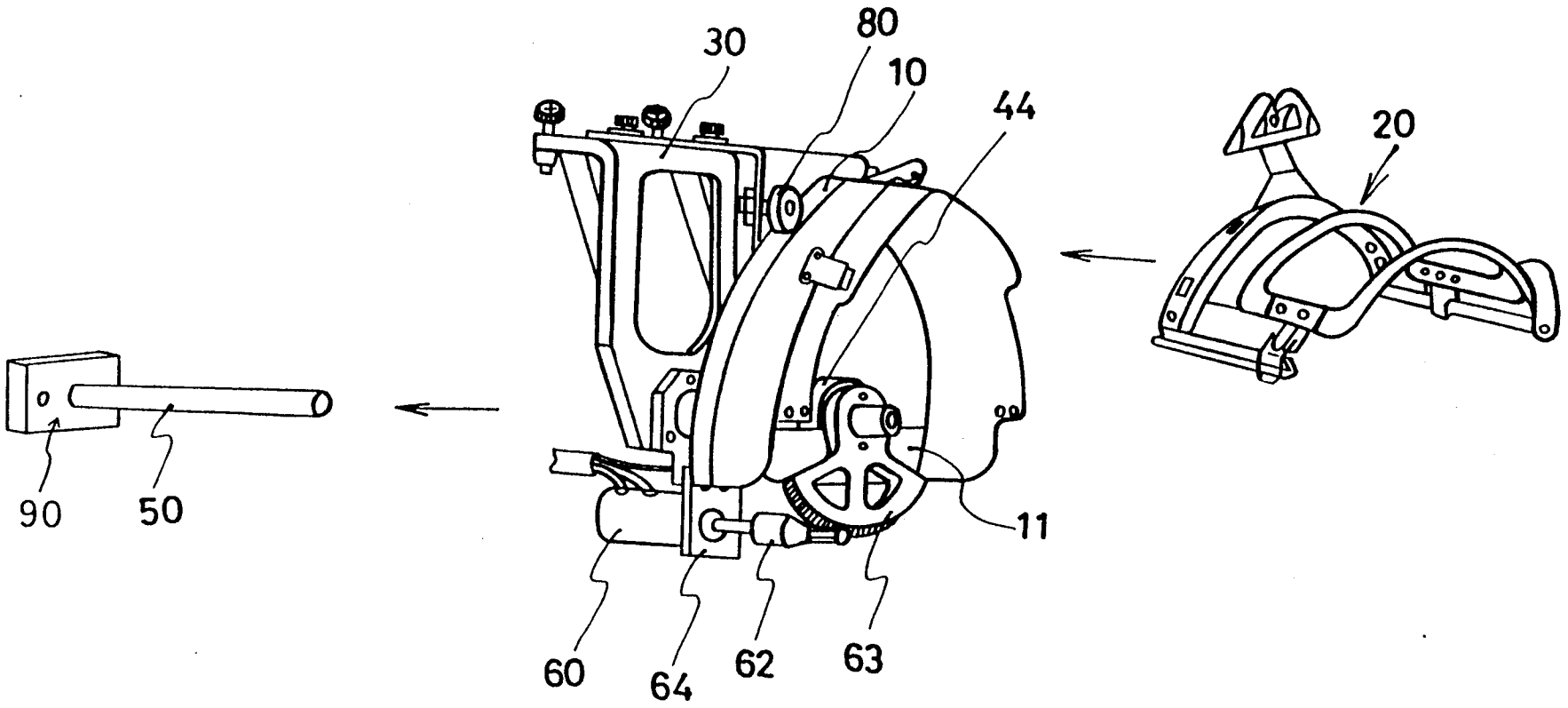
FIG. 1 is a perspective exploded view of an embodiment of a base frame driving device of an embroidering machine according to the present invention.
Figure 2:
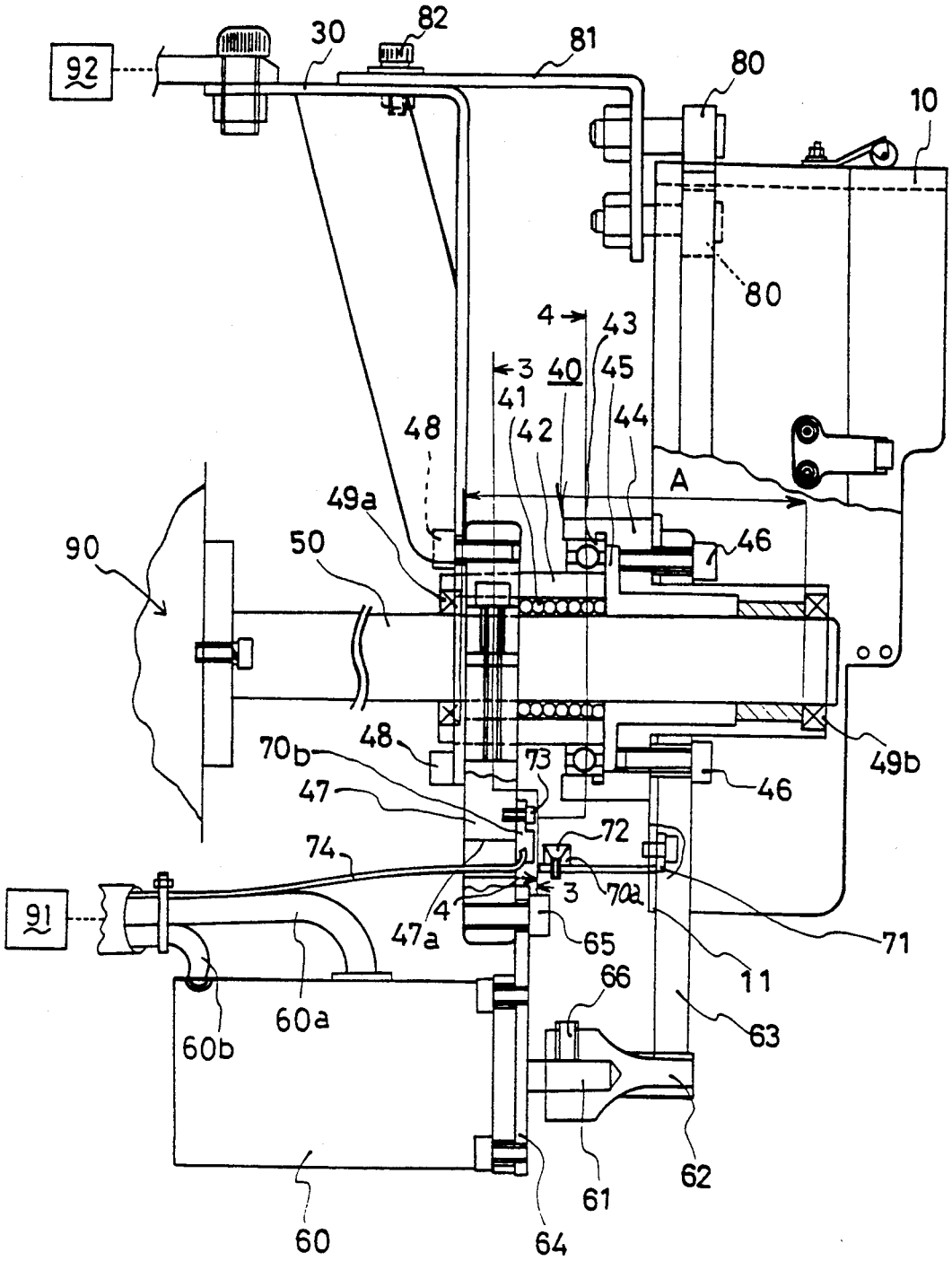
FIG. 2 is a cross-sectional view of the embodiment of a base frame driving device shown in FIG. 1.
Figure 3:
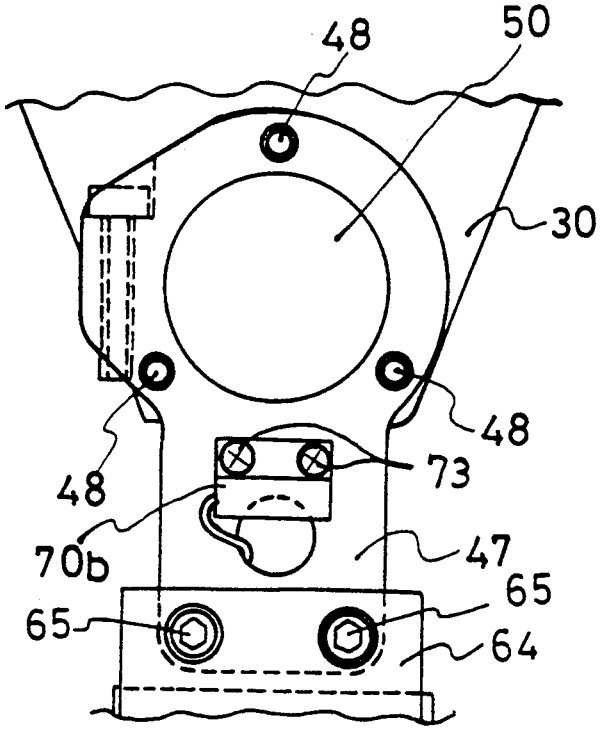
FIG. 3 is a cross-sectional view taken along the line 3—3 in FIG. 2.
Figure 4:
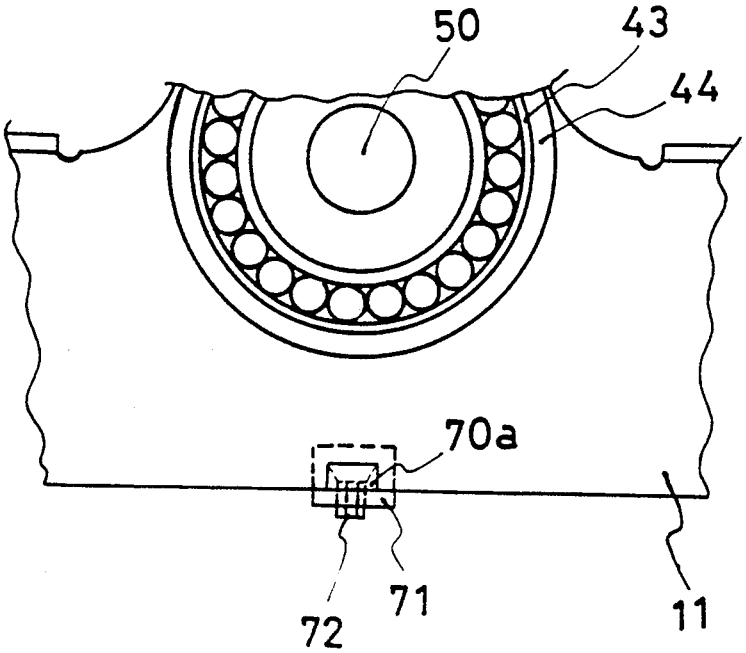
FIG. 4 is a cross-sectional view taken along the line 4—4 in FIG. 2.

Referring to FIG. 1 to FIG. 3 inclusive, a shaft 50 projects from a side of an embroidering machine 90 and a base frame 10 is mounted on the shaft 50 so as to be rotatable thereabout and movable therealong. An embroidering frame 20 is to be detachably mounted on the base frame 10 so that a workpiece (not shown) such as a hat can be held therebetween without creases or wrinkles.

On the shaft 50, there is mounted a connecting portion 40 which operatively connects the holder 30 to the base frame 10. The connecting portion 40 includes a sleeve 42 provided at its inner periphery with a liner bearing 41 for linear movement, a casing 44 mounted via a bearing 43 on the sleeve 42, and a slider 45 movable relative to the shaft 50. The holder 30 is secured via screws 48 to a supporting member 47 which is fixed to the sleeve 42. A main portion 11 of the base frame 10 and a gear 63 are secured to the casing 44, which enables a unitary movement of the casing 44 and the base frame 10. Thus, upon axial movement of the holder 30 along the shaft 50 after the connections of the holder 30 and the base 10 to the connecting portion 40, the base frame 10 is brought into axial movement together with the casing 44. End portions of the sleeve 42 and the casing 44 are provided with oil seals **49*a* and 49*b*, respectively, in order to prevent the invasion of dust toward the liner bearing 41. In this embodiment, a distance A between the oil seals 49*a* and 49*b*** is about 70 mm and is set to be longer than that of the conventional device.

A lower portion of the supporting member 47 is secured via a screw 65 with a bracket 64 on which a motor 60 is fixedly mounted. A shaft 61 of the motor 60 is secured via a screw 66 with a gear 62 so as to be rotated together with the shaft 62. The gear 62 is in meshing engagement with a gear 63, which enables rotation of the base frame 10 about the shaft 50 upon turning-on of the motor 60.

At the lower portion of the main portion 11, there is mounted an L-shaped plate 71 which extends toward the supporting member 47. At a distal end, there is secured a magnet **70*a* by a screw 72. At a center portion of the supporting member 47, a magnetic sensor 70*b* is secured by a screw 73 so as to be in opposition to the magnet 70*a*. A cable 74 having a pair of wires (not shown) between which the sensor 70*b* is interposed is connected to a controller 91 similar to a power supply cable 60*a* and a signal cable 60*b* after being passed through a hole 47*a* in the supporting member 47**.

A retaining member 81 is secured to an upper portion of the holder 30 by a screw 82. The retaining member 81 is bent into the lower direction at a side of the base frame 10 so as to be of an L-shaped configuration, and the bent portion is secured with a pair of closed cam followers 80 and 80. The base frame 10 is so positioned between the cam followers 80 and 80 as to be guided and supported. Such structure enables smooth rotation and axial movement of the base frame 10.

In operation, when the embroidering machine 90 is turned on, the cooperation of the magnetic sensor **70*b* with the magnet 70*a* detects an angular offset of the base frame 10 from a criteria or an initial position, and the resulting signal is fed to the controller 91. Immediately upon receipt of the signal from the sensor 70*b*, the offset angle $\theta$ is calculated, which is converted or transformed into the pulse number P which is represented as a formula $P=(\theta/360)\times N_n$ where N is the basic resolution number, and n is the reducing rate between gears 62** and 63. The controller 91 outputs the calculated pulse number P to the motor 60, and the base frame 10 is rotated to the criteria position.

Thereafter, the embroidering operation per se is initiated. On the basis of the previously stored embroidery data, the controller 91 drives an axial movement driving mechanism 92 for concurrently moving the connecting portion 40 and the holder 30. Thus, the base frame 10 is brought into axial movement along the shaft 50. Simultaneously, the controller 91 drives the motor 60 based on the previously stored embroidery data, for establishing the rotation of the gear 63 which is in meshing engagement with the gear 62 on the shaft 61 of the motor 60. Thus, the base frame 10 to which the gear 63 is secured is brought into swinging movement about the shaft 50. As a whole, the foregoing axial and swinging movements establish the embroidery on the work piece.

According to the foregoing embodiment of the present invention, the embroidering operation can be initiated without manual positioning of the base frame 10 at the criteria position. The reason is that even though the base frame 10 is out of the criteria position, upon initiation of the embroidering operation, the base frame 10 is set to be transferred thereto by the controller 91. In addition, the base frame 10 is held between the cam followers 80 and 80, which enables stable rotation thereof without vibration. Furthermore, the sufficient axial length of the connecting portion 40 in comparison with the conventional device assures the stability of, each of the base frame 10 and the holder 30, by which the rotational accuracy of the motor 60 can be improved up to 700 rpm from the conventional maximum accuracy of 500 rpm resulting in remarkable improvement of the accuracy of the embroidery.

It is to be noted that the position of the magnet 70*a* can be changed.

The invention has thus been shown and described with reference to a specific embodiment, however, it should be noted that the invention is in no way limited to the details of the illustrated structures but changes and modifications may be made without departing from the scope of the appended claims.

What is claimed is:

1. A base frame driving device of an embroidering machine comprising:

a shaft having a longitudinal axis;

a holder slidably mounted on the shaft;

a connecting portion rotatably mounted about the shaft;

a base frame mounted on the connecting portion for holding a work piece to be embroidered, said base frame being mounted for movement about an axis that is concentric with the longitudinal axis of the shaft;

a motor mounted to the holder and operatively connected to the base frame for moving the base frame about an axis that is concentric with the longitudinal axis of the shaft;

a controller for controlling the motor to position the base frame at an initial position relative to the holder upon initiating operation of the embroidering machine.

2. A base frame driving device of an embroidering machine in accordance with claim 1, wherein said controller includes a magnetic sensor provided on the holder and a magnet provided on the base frame so that an offset of the base frame relative to the holder is detected on the basis of relative positioning of the magnet and the magnetic sensor, and depending on the offset the motor moves the base frame to said initial position.

3. A base frame driving device of an embroidering machine in accordance with claim 2, wherein said connecting portion includes a sleeve, said holder being connected to the sleeve via a supporting member, said controller including a magnetic sensor attached to the supporting member.

4. A base frame driving device of an embroidering machine in accordance with claim 3, wherein said base frame includes a main portion on which is mounted a plate that extends towards the supporting member, said controller including a magnet mounted on the plate.

* * * * *